US007040289B2

(12) United States Patent
Nigrin et al.

(10) Patent No.: US 7,040,289 B2
(45) Date of Patent: May 9, 2006

(54) HIGH PRESSURE FUEL ACCUMULATOR

(75) Inventors: Uwe Nigrin, Ilmenau (DE); Mohsen Pirouz, Weisendorf (DE); Stefan Portner, Würzburg (DE); Johann Schneider, Lohr (DE); Ngoc-Tam Vu, Ludwigsburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/902,247

(22) Filed: Jul. 29, 2004

(65) Prior Publication Data

US 2005/0011495 A1 Jan. 20, 2005

Related U.S. Application Data

(63) Continuation of application No. PCT/EP2004/001936, filed on Feb. 26, 2004.

(30) Foreign Application Priority Data

Mar. 4, 2003 (DE) ..... 103 09 311

(51) Int. Cl.
*F02M 55/02* (2006.01)

(52) U.S. Cl. ..... 123/447; 123/456

(58) Field of Classification Search ..... 123/447, 123/456, 468, 469, 506, 514
See application file for complete search history.

(56) References Cited

U.S. PATENT DOCUMENTS 6,488,011 B1 * 12/2002 Frank et al. ..... 123/456
6,640,783 B1 * 11/2003 Braun et al. ..... 123/467

FOREIGN PATENT DOCUMENTS

| | | | |
|---|---|---|---|
| DE | 44 05 432 | C1 | 2/1995 |
| DE | 199 46 611 | A1 | 4/2001 |
| DE | 199 48 255 | A1 | 4/2001 |
| DE | 101 01 476 | A1 | 7/2002 |
| DE | 101 15 859 | A1 | 10/2002 |
| DE | 101 46 548 | A1 | 4/2003 |
| EP | 0 866 221 | A1 | 9/1998 |
| EP | 0 915 252 | A2 | 5/1999 |
| EP | 0 915 252 | A3 | 3/2000 |
| WO | WO 01/09507 | A1 | 2/2001 |

* cited by examiner

*Primary Examiner*—Thomas Moulis
(74) *Attorney, Agent, or Firm*—Baker Botts L.L.P.

(57) ABSTRACT

A high-pressure fuel accumulator (1), in particular for a common rail injection system, has a housing (2) in which a pressure chamber (3) is inserted, and at least one inlet and at least one outlet. The pressure chamber is implemented as a through bore, wherein the through bore is securely sealed with a tie rod nut connection (6) (7). In a high-pressure fuel accumulator the pressure chamber can be implemented as a blind bore, wherein the blind bore being securely sealed with a tie rod (6).

16 Claims, 4 Drawing Sheets

HIGH PRESSURE FUEL ACCUMULATOR

CROSS REFERENCE TO RELATED APPLICATION

This application is a continuation of copending International Application No. PCT/EP2004/001936 filed Feb. 26, 2004 which designates the United States, and claims priority to German application no. 103 09 311.7 filed Mar. 4, 2003.

TECHNICAL FIELD OF THE INVENTION

The present invention relates to a high-pressure fuel accumulator, in particular for common rail injection systems, and to a fuel pump having a said high-pressure fuel accumulator.

DESCRIPTION OF THE RELATED ART

EP 0 866 221 A1 discloses a high-pressure fuel accumulator basically comprising a drawn or rolled tube. Radially disposed connecting nipples are welded or soldered to the circumference of the fuel distributor. The open ends of the tube are each sealed with a closure element. In order to ensure a reliable seal at the high system pressures of up to 1800 bar, special designs of the closure elements are required. For this purpose EP 0 866 221 A1 proposes providing the closure element with an additional sealing ball. Tightening of the threaded plug causes the sealing ball to be forced into the sealing seat of the high-pressure fuel accumulator, said sealing ball having a greater hardness than the sealing seat, thereby causing the latter to deform and ensure a tight seat. Nevertheless, because of pressure fluctuations inside the high-pressure accumulator and setting effects of the thread, leaks may occur on the high-pressure fuel accumulator.

SUMMARY OF THE INVENTION

The object of the invention is therefore to create a high-pressure fuel accumulator that can be securely sealed and is easy and inexpensive to manufacture.

This object can be achieved by a high-pressure fuel accumulator, in particular for a common rail injection system, comprising a housing in which a pressure chamber is inserted, and at least one inlet and at least one outlet, wherein the pressure chamber is implemented as a through bore and said through bore is sealed with a tie rod nut connection.

There can be disposed on or around the tie rod a component whose size can be used to adjust the capacity of the pressure chamber. On the tie rod there can be implemented a sealing cone which, in the installed state, bears on a sealing cone implemented in a complementary manner in the housing. On the lock nut there can be implemented a sealing cone which, in the installed state, bears on a sealing cone implemented in a complementary manner in the housing. An additional seal can be disposed between the housing and the tie rod. An additional seal can also be disposed between the housing and the lock nut. The additional seal can be an elastomeric seal. The lock nut may have a pressure bore and, connected to said pressure bore, a mount for a high-pressure sensor. The pressure bore can be connected to the pressure chamber via an additional bore in the lock nut or in the housing. The pressure bore can be connected to the pressure chamber via a flat spot in the thread of the lock nut. There can be implemented in the region of the cone sealing surfaces a relief bore via which any possible leakage flow can escape. The relief bore can be connected to the low-pressure region of the injection system. There can be implemented on the high-pressure accumulator a connection plateau into which one or more high-pressure connections are inserted.

The object can also be achieved by a high-pressure fuel accumulator, in particular for a common rail injection system, comprising a housing in which a pressure chamber is inserted, and at least one inlet and at least one outlet, wherein the pressure chamber is implemented as a blind bore, said blind bore being sealed with a tie rod which is screwed to the housing.

There can be disposed on or around the tie rod a component whose size can be used to adjust the capacity of the pressure chamber. On the tie rod there can be implemented a sealing cone which, in the installed state, bears on a sealing cone implemented in a complementary manner in the housing. An additional seal can be disposed between the housing and the tie rod. The additional seal can be an elastomeric seal. The housing may have a pressure bore and, connected to said pressure bore, a mount for a high-pressure sensor. The pressure bore can be connected to the pressure chamber via an additional bore in the housing. The pressure bore can be connected to the pressure chamber via a flat spot in the thread of the tie rod. There can be implemented in the region of the cone sealing surfaces a relief bore via which any possible leakage flow can escape. The relief bore can be connected to the low-pressure region of the injection system. There can be implemented on the high-pressure accumulator a connection plateau into which one or more high-pressure connections are inserted.

The object can also be achieved by a fuel pump with one of the high-pressure fuel accumulators as described above, wherein the housing of the fuel pump is simultaneously the housing of the high-pressure fuel accumulator. Between the pressure chamber of the high-pressure fuel accumulator and a bore for accommodating the pump shaft there can be implemented a connecting bore into which the pressure limiting valve is inserted and via which the fuel can escape from the pressure chamber if an opening pressure of the pressure limiting valve is exceeded. In the bore for accommodating the pump shaft there can be implemented a fuel return line via which the fuel can flow back into the low-pressure region of the injection system.

The characteristic feature of the invention is that the pressure chamber is implemented as a blind bore or as a through bore and is sealed with a tie rod or a tie rod nut connection.

The tie rod is screwed on with a high tightening torque, producing in the tie rod a tensile stress which continuously ensures that the pressure chamber is securely sealed even in the event of pressure fluctuations.

Using tie rods of different diameters allows the pressure chamber volume to be adapted to suit the particular requirements. It is therefore no longer necessary to manufacture a high-pressure fuel accumulator with a corresponding pressure chamber volume for every engine variant. This considerably reduces the manufacturing costs of the high-pressure fuel accumulator.

In an advantageous embodiment of the high-pressure fuel accumulator, a component is disposed on or around the tie rod to adapt the pressure chamber volume. This means that both the accumulator itself and the tie rod can be of identical design for every engine variant and only one additional component is required in each case. No particular strength requirements are placed on this component, so that it can be manufactured particularly inexpensively.

In another preferred embodiment of the invention, the head of the tie rod has a sealing cone which, in the installed state, bears on a sealing cone implemented in a complementary manner in a first end opening in the housing, thereby producing in a simple manner a metal seal between the tie rod and said end opening in the housing.

If a tie rod nut connection is used, the lock nut likewise has a sealing cone which, in the installed state, bears on a sealing cone implemented in a complementary manner in a second end opening in the housing, thereby ensuring a reliable and simple seal between the lock nut and said end opening in the housing.

In another preferred embodiment of the invention, an additional seal is disposed between the housing and the tie rod, or between the housing and the lock nut, thereby preventing any leakage from the high-pressure fuel accumulator via the metal seal. An elastomeric seal in the form of an O-ring is preferably used as the additional seal.

In a particularly preferred embodiment of the invention, the high-pressure fuel accumulator is incorporated in the housing of a fuel pump, thereby producing a particularly compact design. For this purpose the pump need not be modified, or only slightly.

BRIEF DESCRIPTION OF THE DRAWINGS

Exemplary embodiments of the invention will now be explained with reference to the accompanying schematic drawings, in which.

DETAILED DESCRIPTION OF THE PREFERRED EMBODIMENTS

Figure 1:
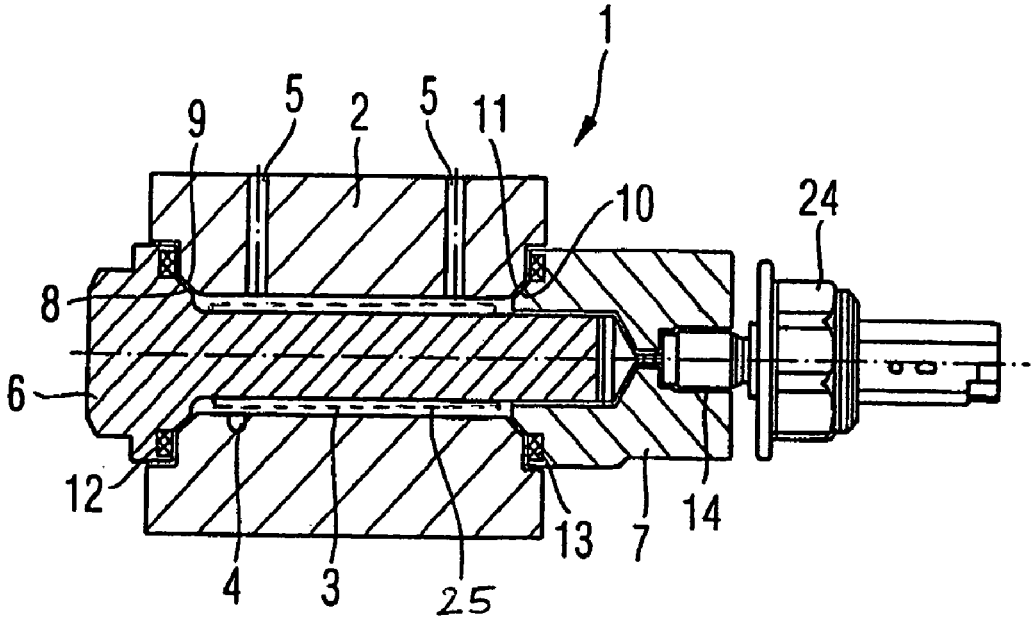
FIG. 1 shows a cross-sectional view of an embodiment of the high-pressure fuel accumulator in the installed state.

FIG. 1 shows an embodiment of the high-pressure fuel accumulator 1. The high-pressure fuel accumulator 1 basically comprises the housing 2 with a pressure chamber 3. The pressure chamber 3 is implemented as a through bore. The pressure chamber 3 has an inlet 4 and four outlets 5 (two of which are visible in the cross-sectional view). The inlet 4 and the outlets 5 lead radially into the pressure chamber 3. The end openings of the high-pressure fuel accumulator 1 are sealed with a tie rod nut connection 6, 7. For this purpose the tie rod 6 is inserted, essentially axially, through the pressure chamber 3 and screwed together with a nut 7 at the opposite side. The screwing-together of the tie rod nut connection 6, 7 introduces tensile stresses into the tie rod 6 which ensure reliable sealing of the pressure chamber 3. The head of the tie rod 6 has a sealing cone 8 which, in the installed state, bears on a sealing cone 9 implemented in a complementary manner in the housing of the high-pressure fuel accumulator 2. The nut 7 likewise has a sealing cone 10 which, in the installed state, bears on another sealing cone 11 implemented in a complementary manner in the housing of the fuel accumulator 2. By bracing the tie rod with the nut 7, the sealing cones 8 and 9 and the sealing cones 10 and 11 are forced tightly against one another, thereby producing a reliable metal seal of the pressure chamber 3. In addition, the tie rod 6 and the nut 7 each have an annular groove to accommodate an additional seal 12, 13 for which an O-ring, for example, can be used. The additional seals 12, 13 prevent any possible leakage from the pressure chamber 3 via the metal seal.

The nut 7 has an axial pressure bore and a mount 14 for a high-pressure sensor 24. The pressure bore is connected to the pressure chamber via an additional bore in the nut or via a flat spot in the thread of the nut.

Using tie rods of different diameters allows the annular pressure chamber 3, i.e. the pressure chamber volume of the high-pressure fuel accumulator, to be varied and adapted to suit the relevant requirements. Therefore a special high-pressure accumulator does not have to be manufactured for every engine variant, but only one tie rod of appropriate diameter need be used. It is likewise possible to dispose around the tie rod a component whose size can be used to set the capacity of the pressure chamber 3. A simple sleeve as indicated in FIG. 1 by the dashed line and numeral 25, for example, is a suitable component for this purpose, no particular requirements being placed on the sleeve in terms of its strength, as it only defines the pressure chamber volume but is not subjected to any tensile stresses. Using a sleeve has the additional advantage that both the same housing and the same tie rod can be used for all required pressure chamber volumes, thereby allowing very inexpensive manufacture of the high-pressure fuel accumulator while simultaneously providing high system flexibility.

Figure 2:
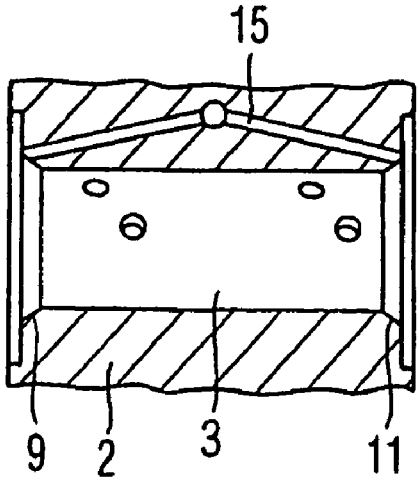
FIG. 2 shows another cross-sectional view of the high-pressure fuel accumulator shown in FIG. 1 in the uninstalled state.

FIG. 2 shows another section through the high-pressure fuel accumulator 1 in a different plane, the high-pressure fuel accumulator being illustrated in the uninstalled state. In the region of the sealing cones 9, 11, two relief bores 15 are provided. Any leakage flow occurring can be discharged via said relief bores 15. The relief bores are connected to the low-pressure region of the fuel injection system or lead directly into the fuel tank. This prevents any pressure increase preceding the additional seals 12, 13 (see FIG. 1) and therefore any damage to said seals.

Figure 3:
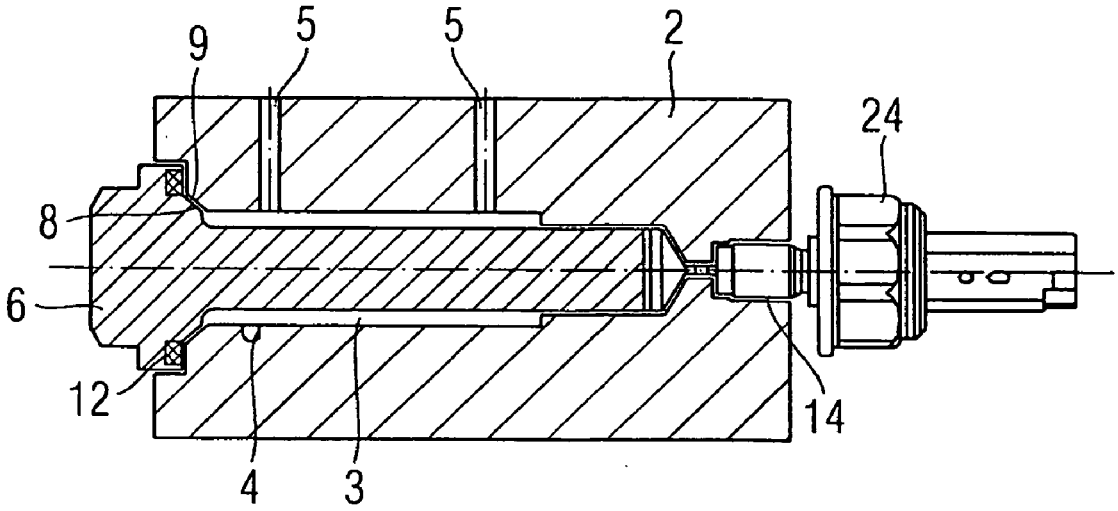
FIG. 3 shows a cross-sectional view of a second embodiment of a high-pressure fuel accumulator in the installed state.

FIG. 3 shows a second embodiment of the high-pressure fuel accumulator 1. The embodiment is basically similar to the high-pressure fuel accumulator shown in FIG. 1. However, in contrast to the first embodiment, the tie rod is not braced using a nut, but is screwed directly to the housing 2 of the high-pressure fuel accumulator. Otherwise the embodiment corresponds to the embodiment shown in FIGS. 1 and 2 whose description will be referred to here.

Figure 4:
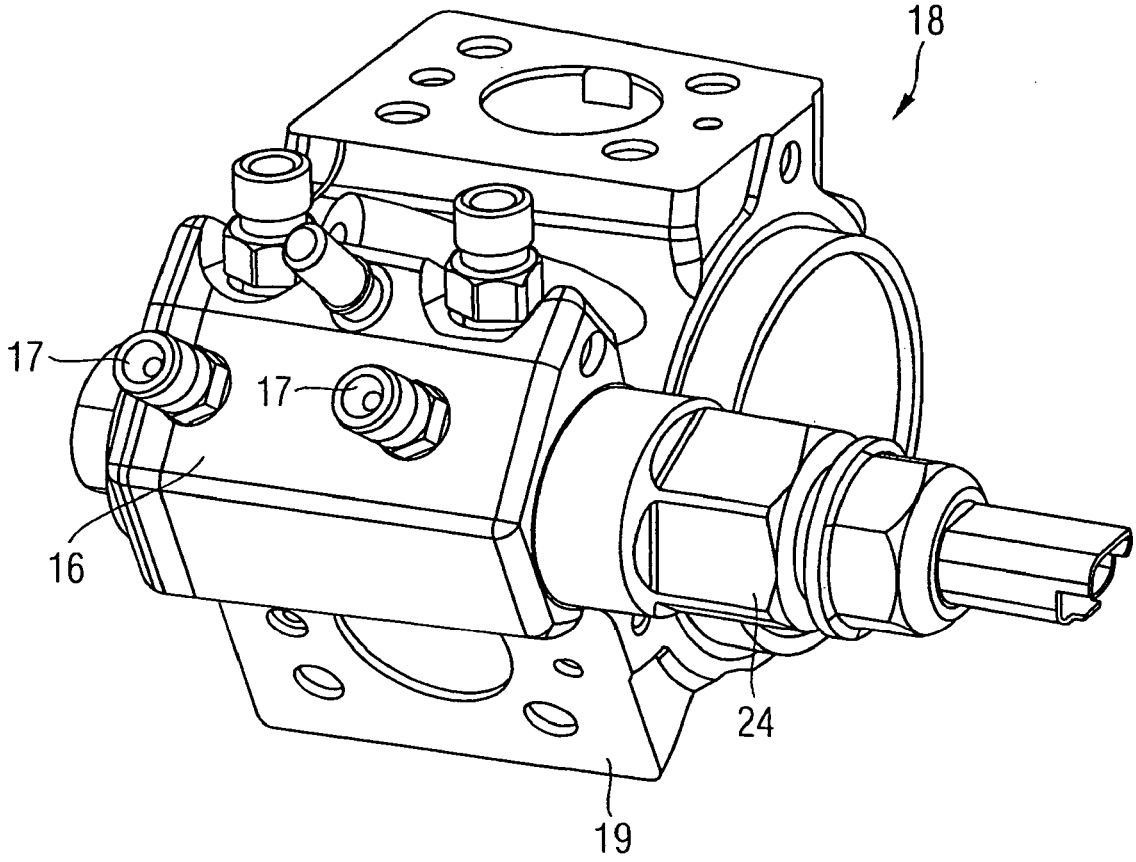
FIG. 4 shows a high-pressure fuel pump having a high-pressure fuel accumulator according to FIG. 1 incorporated in the pump housing.

FIG. 4 shows a high-pressure fuel pump 18 in which the high-pressure fuel accumulator 1 according to the invention is directly incorporated in the fuel pump housing 19. For this purpose the pump housing 19 can remain essentially unchanged, as the design of the pump housing 19 as a high-pressure-resistant component means that at certain locations of the pump housing sufficient spare material is available in order to incorporate the high-pressure fuel accumulator 1. The high-pressure fuel accumulator 1 has high-pressure fuel outputs 17 which are each connected to the individual injectors of the internal combustion engine. Incorporating the high-pressure fuel accumulator 1 in the fuel pump 18 results in a very compact design of the fuel injection system. It additionally eliminates the cost-intensive manufacture of an additional high-pressure fuel accumulator. For ease of attaching the high-pressure fuel outputs to the high-pressure fuel accumulator, a connection plateau 16 is provided on the housing of the high-pressure fuel accumulator.

Figure 5:
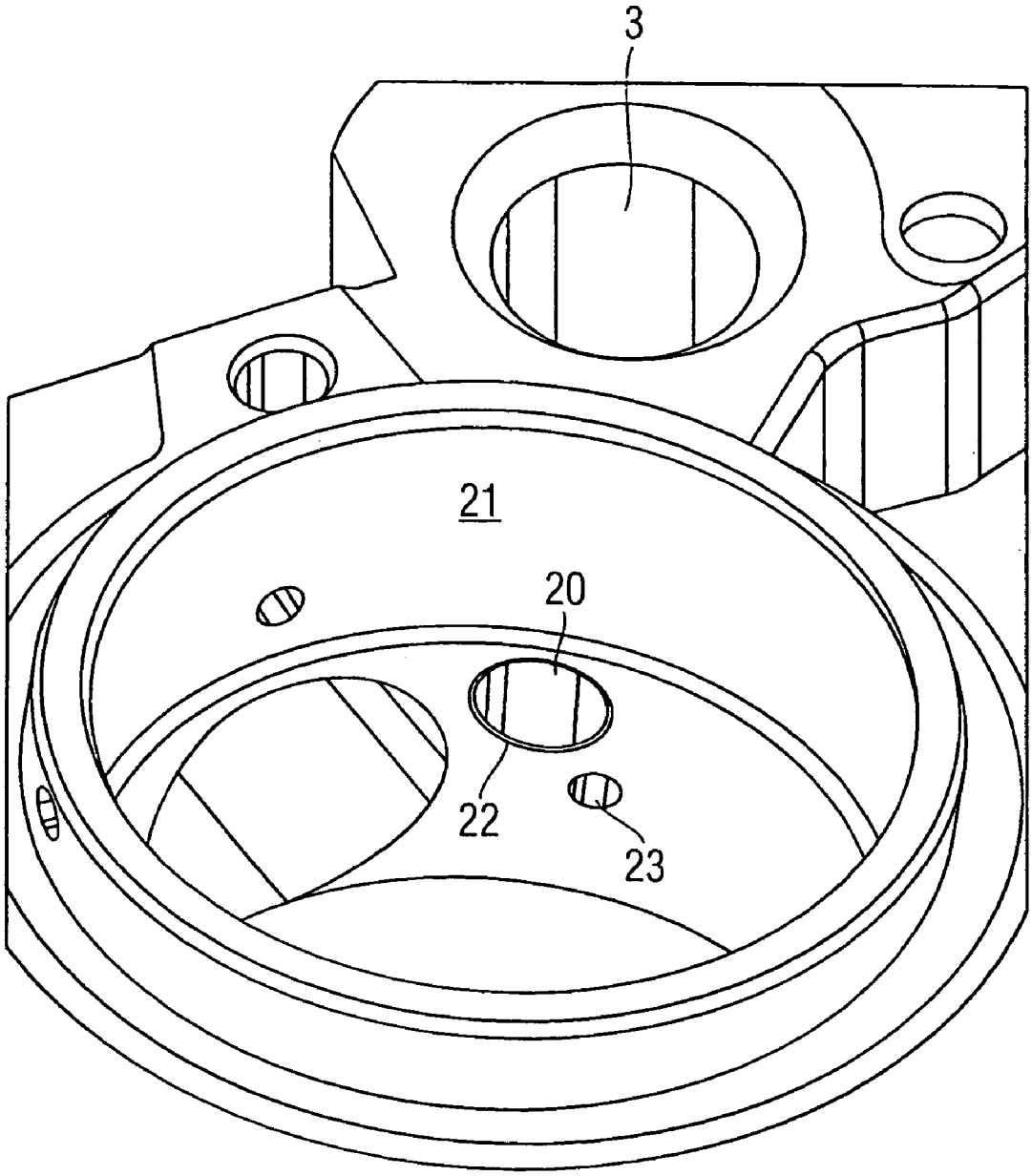
FIG. 5 shows a detail view of the high-pressure fuel accumulator shown in FIG. 4.

FIG. 5 shows a detail view of the fuel pump according to FIG. 4. Between the pressure chamber 3 and the bore for accommodating the pump shaft 21 there is a connecting bore 20. In said connecting bore 20 there is disposed a pressure limiting valve 22. If a defined opening pressure of the pressure limiting valve is exceeded, the fuel can escape from the pressure chamber 3 via the pressure limiting valve. The fuel can additionally flow back into the low-pressure region of the fuel injection system via the fuel return line 23 installed in the bore for accommodating the pump shaft 21. The pressure limiting valve 22 can be implemented as a simple mechanical pressure limiting valve. This obviates the need to use an additional pressure control valve on the high-pressure pump or accumulator as is generally the case in injection systems, thereby providing significant cost savings and simplifications of the system as a whole.

The invention therefore relates to a high-pressure fuel accumulator whose end openings are securely and inexpensively sealed by means of a tie rod or a tie rod nut connection. Varying the tie rod diameter or using an additional component disposed around the tie rod enables the pressure chamber volume to be adapted very simply and inexpensively to the relevant requirements without necessitating additional modifications to the high-pressure fuel accumulator itself. Incorporating the high-pressure fuel accumulator into the existing overall dimensions of a fuel pump results in a very compact design. Additionally incorporating a pressure limiting valve obviates the need to use an otherwise necessary pressure control valve on the high-pressure fuel pump or high-pressure accumulator. All in all, there is therefore produced a very compact fuel injection system which can be very flexibly adapted to the relevant requirements, is inexpensive to manufacture and ensures reliable sealing of the high-pressure fuel accumulator.

The invention is of course not limited to the exemplary embodiments shown in the Figures. In particular, it is possible to use the high-pressure fuel accumulator incorporated in the fuel pump merely as the distributor rail and additionally use yet more high-pressure fuel accumulators.

We claim:

1. A high-pressure fuel accumulator comprising a housing in which a pressure chamber is inserted, and at least one inlet and at least one outlet, wherein the pressure chamber is implemented as a through bore and said through bore is sealed with a tie rod nut connection.

2. The high-pressure fuel accumulator according to claim 1, wherein there is disposed on or around the tie rod a component whose size can be used to adjust the capacity of the pressure chamber.

3. The high-pressure fuel accumulator according to claim 1, wherein on the tie rod there is implemented a sealing cone which, in the installed state, bears on a sealing cone implemented in a complementary manner in the housing.

4. The high-pressure fuel accumulator according to claim 1, wherein on a lock nut of said tie rod nut connection there is implemented a sealing cone which, in the installed state, bears on a sealing cone implemented in a complementary manner in the housing.

5. The high-pressure fuel accumulator according to claim 1, wherein an additional seal is disposed between the housing and the tie rod.

6. The high-pressure fuel accumulator according to claim 1, wherein an additional seal is disposed between the housing and the lock nut.

7. The high-pressure fuel accumulator according to claim 5, wherein the additional seal is an elastomeric seal.

8. The high-pressure fuel accumulator according to claim 1, wherein the lock nut has a pressure bore and, connected to said pressure bore, a mount for a high-pressure sensor.

9. The high-pressure fuel accumulator according to claim 8, wherein the pressure bore is connected to the pressure chamber via an additional bore in the lock nut or in the housing.

10. The high-pressure fuel accumulator according to claim 8, wherein the pressure bore is connected to the pressure chamber via a flat spot in the thread of the lock nut.

11. The high-pressure fuel accumulator according to claim 1, wherein there is implemented in the region of the cone sealing surfaces a relief bore via which any possible leakage flow can escape.

12. The high-pressure fuel accumulator according to claim 11, wherein the relief bore is connected to the low-pressure region of the injection system.

13. The high-pressure fuel accumulator according to claim 1, wherein there is implemented on the high-pressure accumulator a connection plateau into which one or more high-pressure connections are inserted.

14. A fuel pump with a high-pressure fuel accumulator according to claim 1, wherein a housing of the fuel pump is simultaneously the housing of the high-pressure fuel accumulator.

15. The fuel pump according to claim 14, wherein between the pressure chamber of the high-pressure fuel accumulator and a bore for accommodating a pump shaft there is implemented a connecting bore into which a pressure limiting valve is inserted and via which the fuel can escape from the pressure chamber if an opening pressure of the pressure limiting valve is exceeded.

16. The fuel pump according to claim 15, wherein in the bore for accommodating the pump shaft there is implemented a fuel return line via which the fuel can flow back into the low-pressure region of the injection system.

* * * * *